US008256052B2

(12) United States Patent
Hanselmann et al.

(10) Patent No.: US 8,256,052 B2
(45) Date of Patent: Sep. 4, 2012

(54) BOOM OF A LAYING MECHANISM AND METHOD OF MOVING THE BOOM INTO A VEHICLE TRANSPORT POSITION

(75) Inventors: Lutz Hanselmann, Mainz (DE); Michael Wagner, Reich (DE); Uwe Beitz, Ellern (DE); Klaus Schiffmann, Ginsheim (DE)

(73) Assignee: Krauss-Maffei Wegmann GmbH & Co. KG (DE)

( * ) Notice: Subject to any disclaimer, the term of this patent is extended or adjusted under 35 U.S.C. 154(b) by 492 days.

(21) Appl. No.: 12/364,964

(22) Filed: Feb. 3, 2009

(65) Prior Publication Data

US 2009/0194499 A1 Aug. 6, 2009

(30) Foreign Application Priority Data

Feb. 6, 2008 (DE) ..... 10 2008 007 715

(51) Int. Cl.
*E01D 15/00* (2006.01)

(52) U.S. Cl. ..... 14/2.5; 14/2.4

(58) Field of Classification Search ..... 14/2.4, 14/2.5, 77.1, 78

See application file for complete search history.

(56) References Cited

U.S. PATENT DOCUMENTS

| | | | | |
|---|---|---|---|---|
| 3,820,181 | A * | 6/1974 | Wagner et al. | 14/2.5 |
| 3,871,045 | A * | 3/1975 | Bouvet et al. | 14/2.4 |
| 4,023,226 | A * | 5/1977 | Soffge et al. | 14/2.4 |
| 4,510,637 | A * | 4/1985 | Zlotnicki | 14/2.4 |
| 4,602,399 | A * | 7/1986 | Jenkins | 14/2.4 |
| 4,649,587 | A * | 3/1987 | McFarlane et al. | 14/2.4 |
| 5,067,191 | A | 11/1991 | Kinzel et al. | |
| 5,276,930 | A * | 1/1994 | Parramore | 14/2.5 |
| 5,276,931 | A * | 1/1994 | Karcher et al. | 14/2.5 |
| 5,507,057 | A * | 4/1996 | Diefendahl et al. | 14/2.4 |
| 5,937,468 | A | 8/1999 | Wiedeck et al. | |
| 7,568,252 | B2 * | 8/2009 | Fraundorfer | 14/2.5 |

FOREIGN PATENT DOCUMENTS

| | | | |
|---|---|---|---|
| DE | 3737681 | A1 * | 5/1989 |
| DE | 10 2005 041 493 | | 4/2007 |
| EP | 362063 | A1 * | 4/1990 |
| FR | 2678297 | A1 * | 12/1992 |

* cited by examiner

*Primary Examiner* — Robert Pezzuto
*Assistant Examiner* — Matthew D Troutman
(74) *Attorney, Agent, or Firm* — Robert Becker & Assoc.; Robert Becker

(57) ABSTRACT

Boom of a laying mechanism of a bridge laying vehicle, the laying mechanism being composed of a placement arm and the boom. The boom includes a base member that can be fixedly secured to the vehicle by at least one securement device. A jib, especially with locking elements for locking a bridge element in place, is moveable relative to the base member. A pivot member is pivotably disposed on the base member, and the jib is pivotably disposed on the pivot member. Pursuant to the method for moving the boom into a vehicle transport position, the jib is pivoted about a pivot axis in the forward direction of travel by raising the pivot axis of the jib.

18 Claims, 13 Drawing Sheets

BOOM OF A LAYING MECHANISM AND METHOD OF MOVING THE BOOM INTO A VEHICLE TRANSPORT POSITION

The instant application should be granted the priority date of Feb. 6, 2008 the filing date of the corresponding German patent application 10 2008 007 715.1-25.

BACKGROUND OF THE INVENTION

The present invention relates to a boom of a laying or placement mechanism of a bridge laying vehicle, wherein the laying mechanism is composed of a placement arm and the boom. The present invention also relates to a method of moving a boom of a bridge laying vehicle into a vehicle transport position.

The present invention finds application on, in particular, military bridge laying vehicles that can transport and lay bridge elements. The laying or placement vehicles can be wheeled or chained vehicles. Laying vehicles are generally provided with a placement arm, which is in particular disposed at the front end of the vehicle, but can also be disposed at the rear end. In this connection, the placement arm serves for the laying or placement of the bridge elements; in other words, the bridge elements can be deposited and again picked up via the placement arm. In addition, such vehicles are provided with a boom, which is in particular disposed at the rear of the vehicle, but can also be disposed at the front. The boom is generally provided with locking elements, such as, for example, a bolt locking mechanism via which the bridge elements can be locked in position, raised and held. Such a bridge laying vehicle is described, for example, in U.S. Pat. No. 5,067,191 or U.S. Pat. No. 5,937,468. The boom is generally moved by means of an adjustment device, such as a hydraulic cylinder.

The drawback of the known configurations is that only bridge elements having a single prescribed length can be transported and placed. Bridge elements having a different length cannot be transported in particular for the reason that otherwise the center of gravity of the vehicle together with the bridge element is shifted, so that it is no longer possible to travel in a stable position. For this reason, the laying vehicle, together with the boom, must be adapted to or coordinated with the bridge elements that are to be transported and placed.

A further drawback is that with modern laying vehicles, supplemental armoring, such as, for example, a protection against mines, is provided in the front region of the vehicle and shifts the center of gravity of the vehicle. Thus, however, the laying mechanism, which is composed of a placement arm and a boom, must also be structurally adapted, so that a subsequent provision of a supplemental armoring on the vehicle is possible only at very great expense if there is to be no loss of stability, especially at the traveling speed.

A further drawback of the known laying vehicles is that the boom projects upwardly and toward the rear or toward the front, thus making transport of the bridge laying vehicle, for example via a towing vehicle, more difficult. This problem, and a possible solution, are provided in DE 10 2005 041 493 B3. The rear boom described in this document can be brought into a vehicle transport position for transport of the vehicle. The boom is provided with an arm that is designated as a rear beam and that is pivotably disposed on a base member that is designated as a rear frame. The base member is fixedly connected to the vehicle. During the laying or placement of a bridge element, the arm can be pivoted by means of a hydraulic cylinder. The cylinder is supported against a traverse or cross beam that is pivotably disposed on the base member, whereby during the placement process the pivoting movement is prevented by a bolt fixation means. If the boom is brought into a vehicle transport position, the traverse can be lowered via the cylinder, so that in the vehicle transport position the boom has a lesser extension in the vertical direction while having the same extension in the longitudinal direction of the vehicle.

A drawback of the configuration described above is that the arm cannot be moved downwardly to an adequate extent since it is still joined or linked to the base member. In addition, the transition into the vehicle transport position is very complicated, since bolts have to be repeatedly relocated. Furthermore, it is also not possible to shift the center of gravity for accommodating different bridge elements or when a supplemental armoring is provided.

It is an object of the present invention to design a boom with an increased moveability in order, for example, to better move it into a vehicle transport position.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
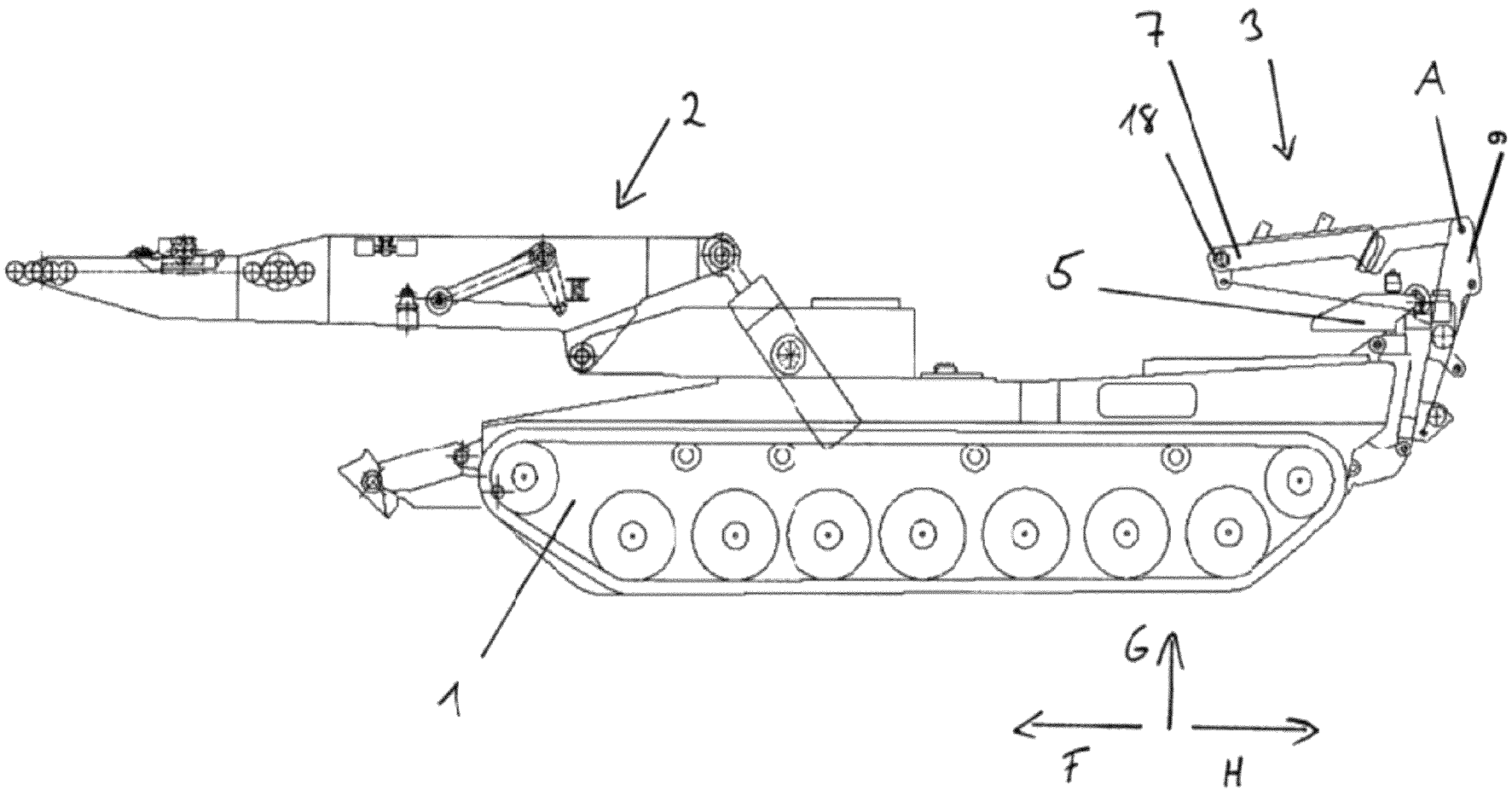
FIG. 1 shows one exemplary embodiment of a bridge laying vehicle having a boom in the vehicle transport position.

The inventive boom realizes the object of the present invention by being comprised of a base member, at least one securement device for fixedly securing the base member to the bridge laying vehicle, a pivot member that is pivotably disposed on the base member, and a jib that is pivotably disposed on the pivot member, so that the jib is moveable relative to the base member. The inventive method for moving a beam into a vehicle transport position, wherein the laying mechanism is composed of a placement arm and the boom, wherein the boom is comprised of a base member that is adapted to be fixedly secured to the bridge laying vehicle via at least one securement device, and wherein the boom further comprises a jib that is moveable relative to the base member, realizes the object of the present invention by providing for the step of pivoting the jib about a pivot axis in a forward direction of travel of the bridge laying vehicle by raising the pivot axis of the jib.

A basic concept of the present invention is to pivotably dispose a pivot member on the base member, which can be fixedly secured to the bridge laying vehicle by means of a securement device, and further to pivotably dispose the jib on the pivot member. As a consequence of the insertion of this intermediate element, pursuant to the present invention the boom is provided with two pivot axes, thus imparting a greater moveability to the boom. This greater moveability is advantageous since as a result different bridge elements can be laid and transported, whereby in particular the center of gravity of the loaded bridge laying vehicle can be adapted to the bridge elements that are to be transported and/or to the supplemental armoring. Furthermore, the inventive apparatus makes it possible to bring the boom into a vehicle transport position in which the dimensions in the vertical direction and in the longitudinal direction of the vehicle are significantly reduced.

For the pivoting movement of the pivot member relative to the base member, the boom can be provided with a pivot member adjustment device, in particular a hydraulic pivot member cylinder. In addition, for the pivoting movement of the jib relative to the pivot member, the boom can be provided with a jib adjustment device, in particular a hydraulic jib cylinder, with the jib adjustment device in particular also being independent of the pivot member adjustment device. The boom thus preferably has two adjustment devices that are embodied and operable independently of one another. The adjustment devices can, for example, also be embodied as linear drives.

Pursuant to a particularly preferred embodiment of the present invention, one end of the jib adjustment device is supported on the pivot member; in addition, one end of the pivot member adjustment devices should be supported on the pivot member. Thus, an uncoupling of the jib from the base member can be achieved by the provision of the interposed pivot member.

So that the load of the bridge elements in the bridge transport position of the rear boom does not rest entirely upon the pivot member adjustment device, at least one strut, and preferably two struts, can be provided between the base member and the pivot member, whereby the struts carry the load of the bridge element. During a pivoting movement of the pivot member relative to the base member, the struts can be guided by means of a guide slot. In the bridge transport position, the struts can be locked in position by means of an arresting device, in particular by means of arresting cylinders, thus increasing the stability and the safety. The boom can in addition be provided with sensors that detect the position of the pivot member and/or of the jib.

The boom can be brought into a vehicle transport position by pivoting the pivot member upwardly by means of the pivot member adjustment device, so that the jib, by means of the jib adjustment device, proceeding from the pivot axis thereof can be pivoted essentially toward the front in the direction of travel. Thus, the pivot axis of the jib can be brought over the base member, so that in the vehicle transport position, the jib forms an angle of +30° to −30°, preferably +10° to −10°, relative to the horizontal. In the vehicle transport position, the jib is preferably disposed in the horizontal.

The pivot axis of the jib is preferably raised in such a way that it lies above a horizontal plane that extends through the highest point of the base member. Thus, the base ember is no longer in the way during the pivoting movement of the jib. Raising the pivot axis additionally results in the advantage that also the dimensions of the boom can be reduced in the longitudinal direction of the vehicle.

For safety purposes, the vehicle transport position can be secured by means of a fixation device, in particular by bolts.

Thus, in the vehicle transport position the amount by which the boom extends above or beyond the base member in the rearward or forward direction, and/or in the vertical direction, can be reduced relative to a bridge transport position.

The boom can additionally be moved into a towing position. This position is assumed when the laying vehicle, loaded with bridge elements, is incapable of being driven and, together with the bridge elements, is to be towed away, for example by a recovery tank. In the towing position, the boom and the bridge elements are no longer located in the region of the towing rod and the recovery vehicle, thus making towing possible in a safe manner.

In view of the above, the inventive boom thus fulfills, among others, the following functions:

1. Securement of the bridge in the transport position while taking into account the center of gravity.
2. Coupling of two bridge elements in coordination with the jib.
3. Travel in a vehicle transport position.
4. Travel in a towing position.

Further specific features of the present invention will be described in detail subsequently.

DESCRIPTION OF SPECIFIC EMBODIMENTS

Referring now to the drawings in detail, FIG. 1 shows a chain-driven bridge laying or placement vehicle 1 having a placement arm 2 at the front end and a boom 3 at the rear end. The boom 3 is comprised of three elements, namely a base member 5 that is fixedly connected with the bridge laying vehicle 1, a pivot member 6 that is pivotably disposed on the base member 5, and a jib or arm 7 that is pivotably disposed on the pivot member 6. Disposed on both sides of the jib 7 are locking elements 18 with bolts for the locking or bolting of a bridge element.

Figure 2:
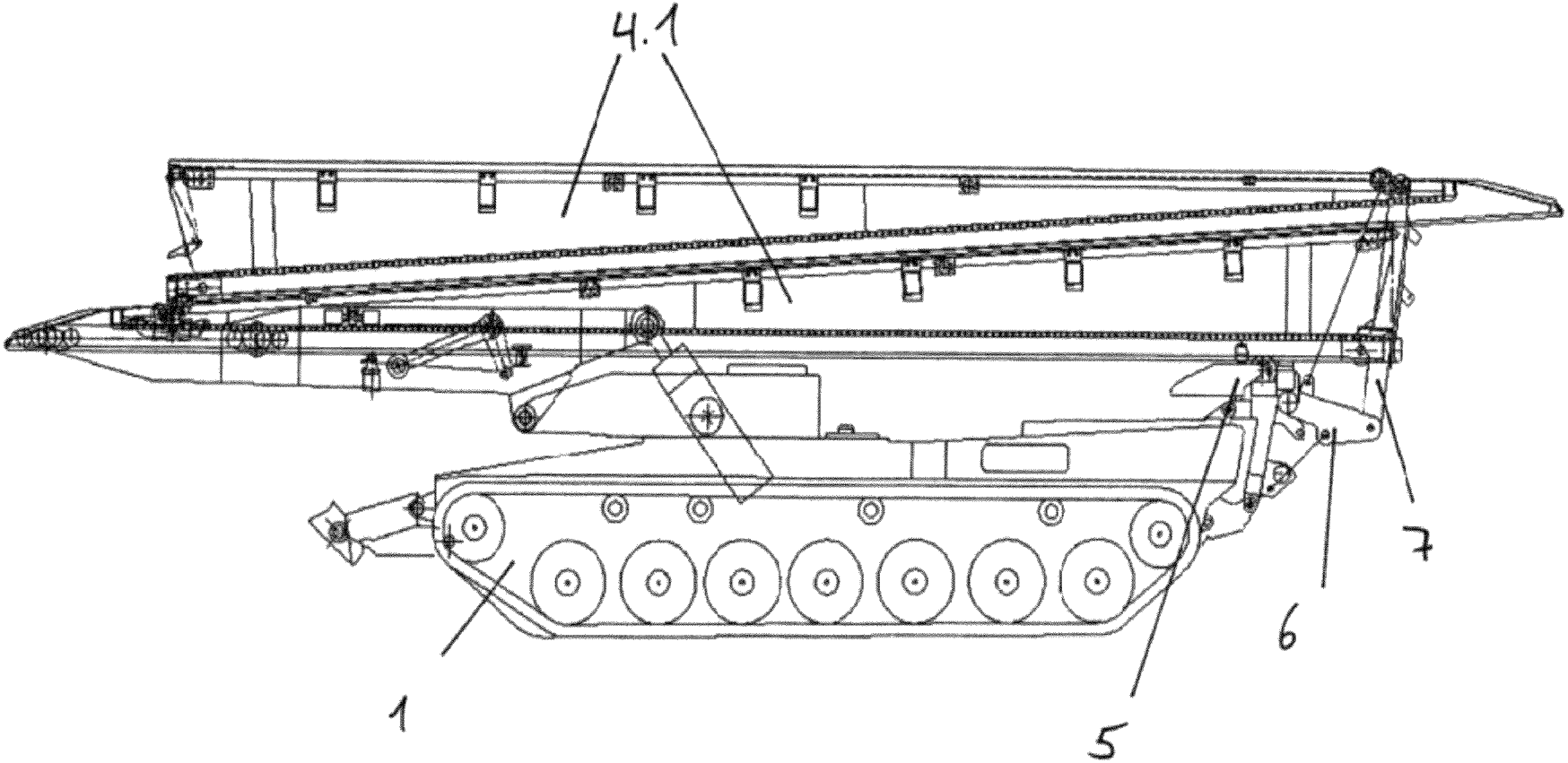
FIG. 2 shows the bridge vehicle of FIG. 1 with a supplemental armoring in the front region during the transport of two bridge elements having the length X.
Figure 3:
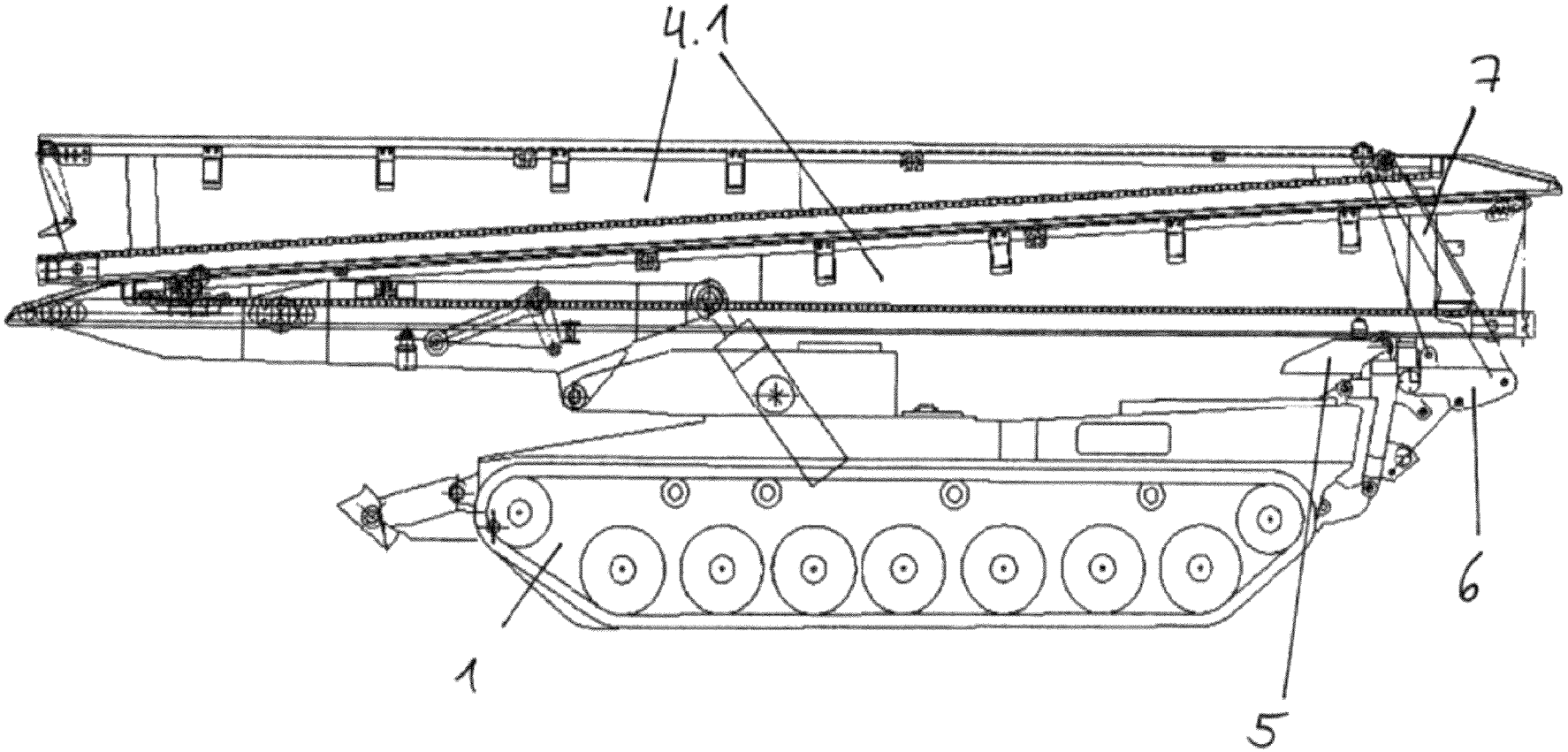
FIG. 3 shows the bridge laying vehicle of FIG. 1 without supplemental armoring during the transport of two bridge elements having the length X.
Figure 6:
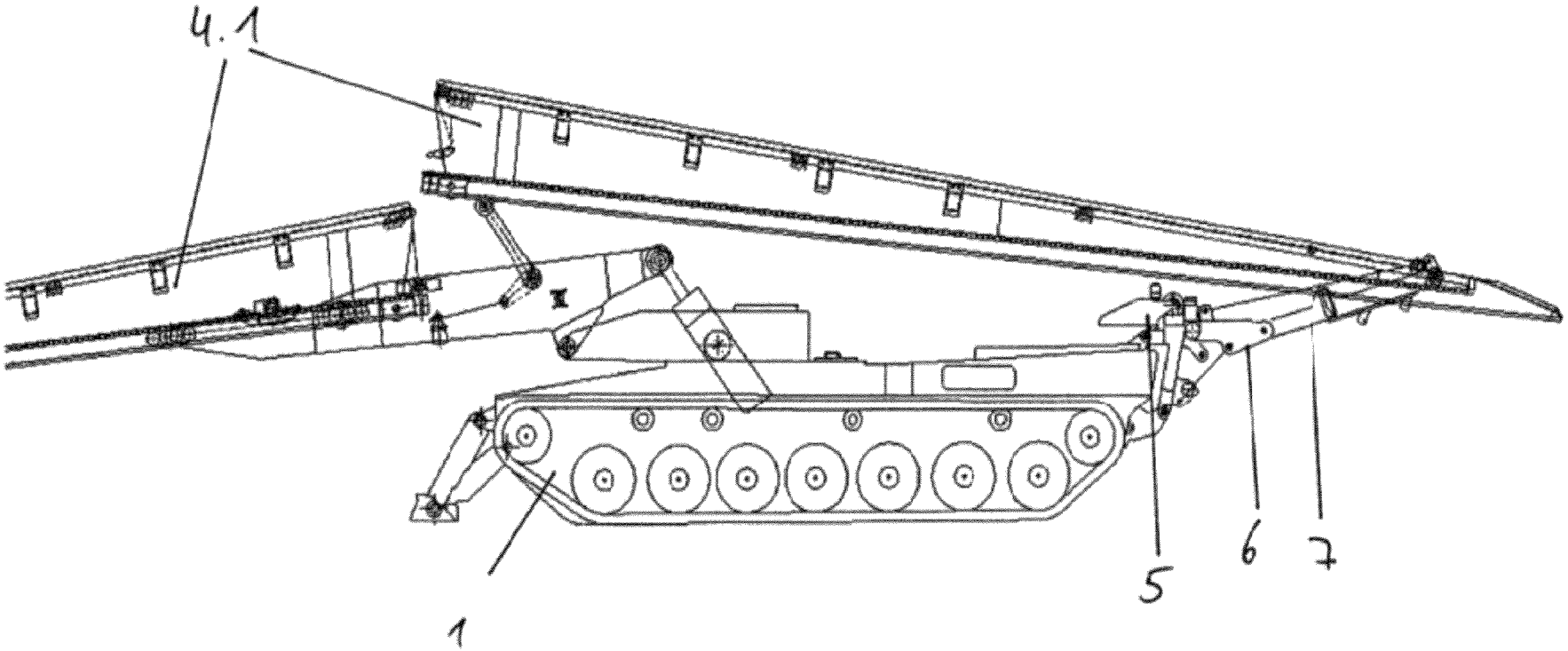
FIG. 6 shows the bridge laying vehicle of FIG. 1 during coupling of the two bridge elements having the length X.

FIGS. 2 and 3 show the bridge laying vehicle 1, which is transporting two bridge elements 4.1 having a prescribed length X. The bridge elements 4.1 can be coupled to form a bridge. The coupling process is illustrated in FIG. 6.

The bridge laying vehicle illustrated in FIG. 2 is provided in the forward region with a protection against mines as a supplemental armoring, so that the center of gravity of the vehicle 1 is displaced toward the front relative to the vehicle illustrated in FIG. 3, which has not supplemental armoring. In order to compensate for this, the boom in FIG. 2 is controlled in such a way that the bridge elements 4.1, in particular the upper bridge element 4.1, is disposed further toward the rear. As a result, the center of gravity of the loaded vehicle 1 is again brought to the intended position, so that the stability and safety are ensured while traveling.

Figure 4:
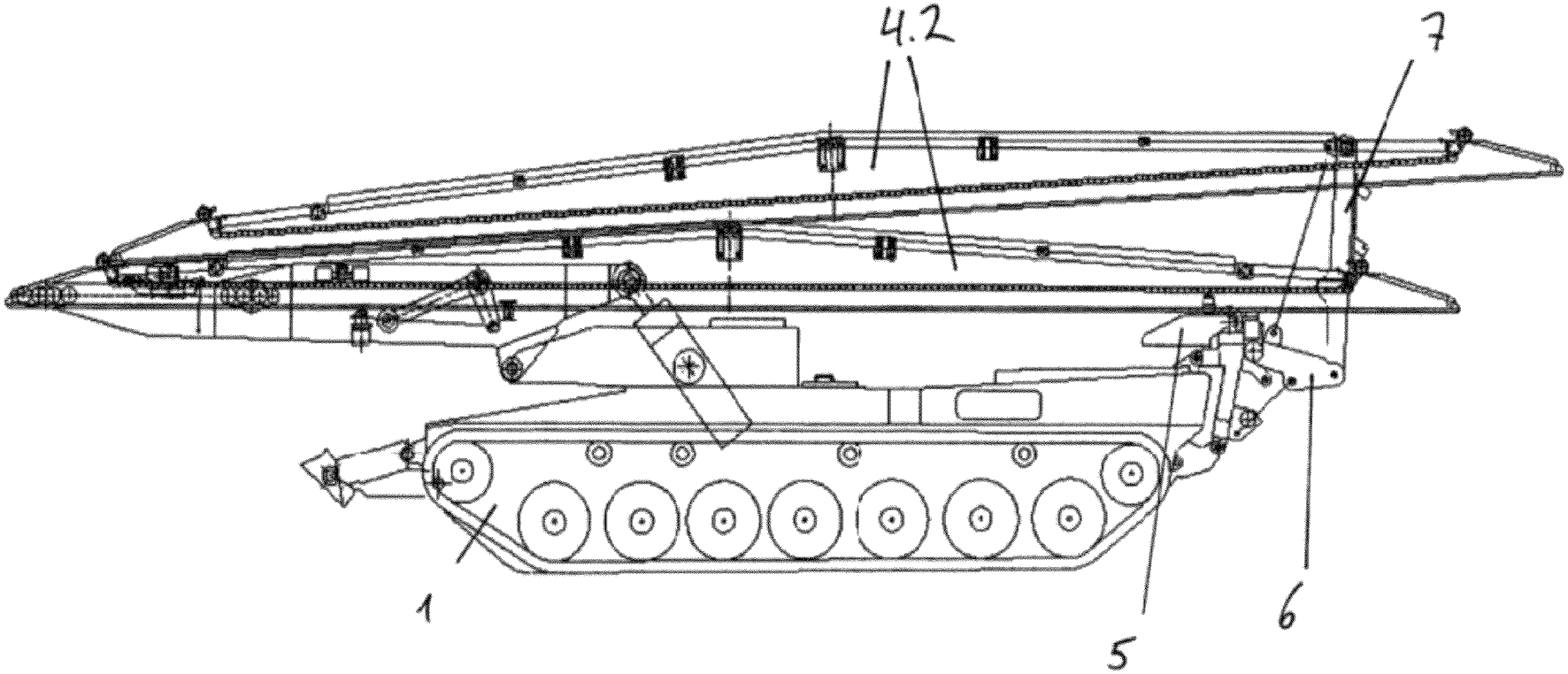
FIG. 4 shows the bridge laying vehicle of FIG. 1 with a supplemental armoring in the front region during the transport of two bridge elements having the length Y.
Figure 5:
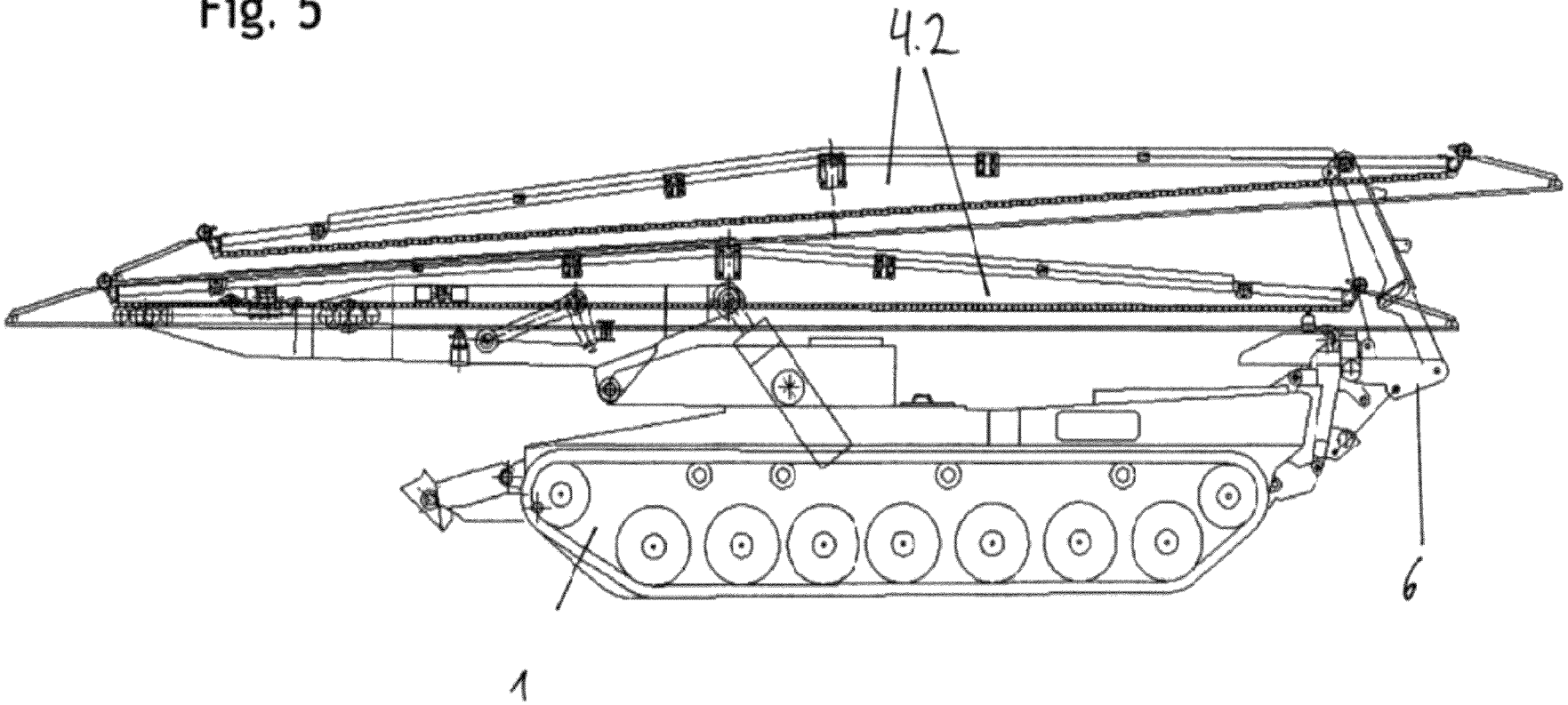
FIG. 5 shows the bridge laying vehicle of FIG. 1 without supplemental armoring during the transport of two bridge elements having the length Y.

The inventive boom 3 additionally has the advantage that bridge elements having a different length can also be transported. This is illustrated FIGS. 4 and 5. The bridge elements 4.2 being transported here have a length Y, and can be placed individually, in other words, they do not have to be coupled. It is also possible when transporting the bridge elements 4.2 to shift the center of gravity, for example if the bridge laying vehicle 1 is provided with a supplemental armoring, as illustrated in FIG. 4.

Figure 7:
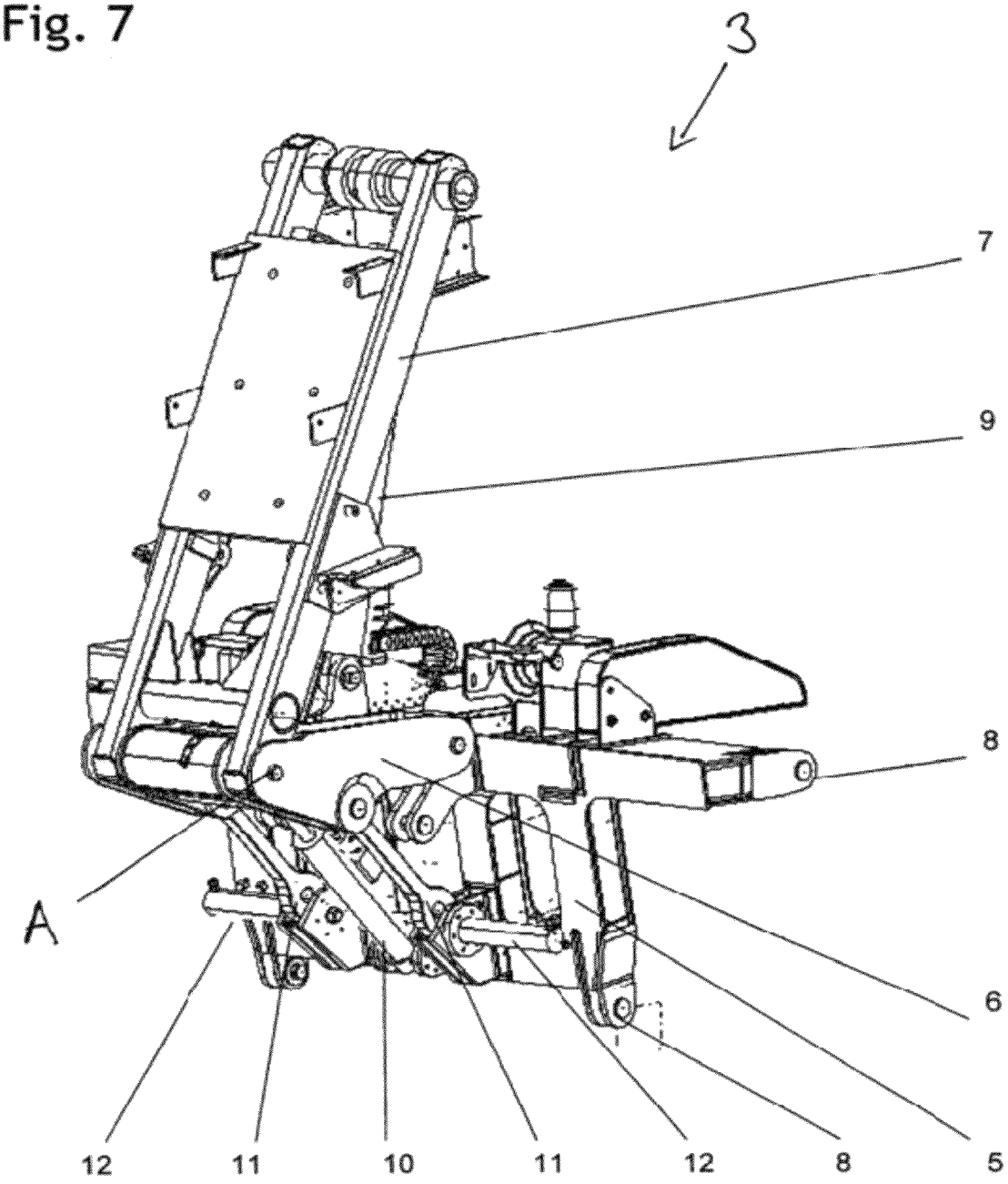
FIG. 7 is a perspective illustration of the boom of FIG. 1.
Figure 8:
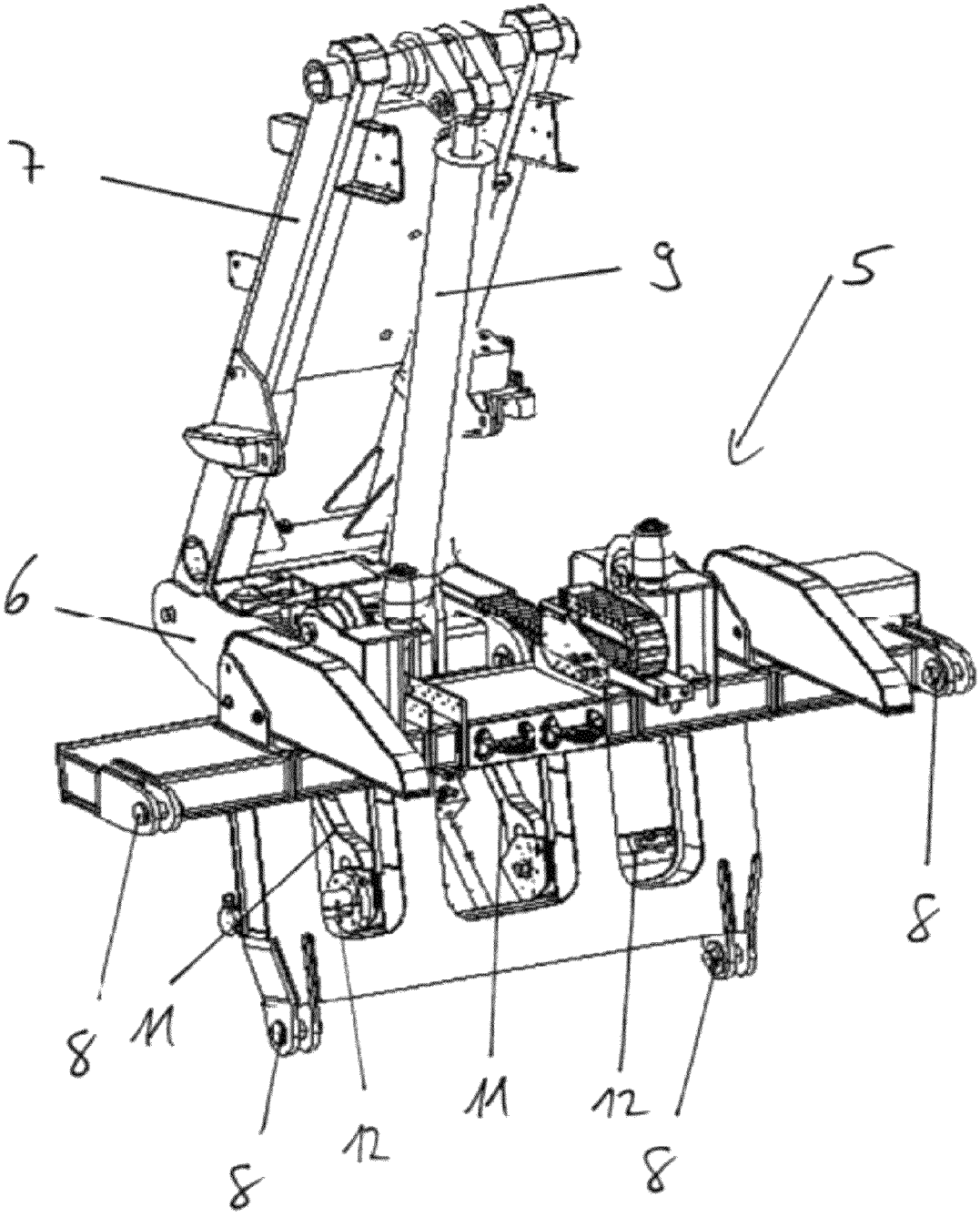
FIG. 8 is a rotated view of the boom of FIG. 7.

The inventive boom 3 is illustrated in perspective in FIGS. 7 and 8, and is provided with a base member or mounting base 5 that can be secured to the bridge laying vehicle 1 by means of four securement devices 8. Pivotably disposed on the base member 5 is a pivot member 6. The pivoting movement of the pivot member 6 relative to the base member 5 is effected by a hydraulic pivot member cylinder 10 as a pivot member adjustment mechanism. Pivotably disposed on the base member 5 is the jib 7. The pivoting movement of the jib 7 relative to the pivot member 6 is effected by a hydraulic jib cylinder 9 as a jib adjustment mechanism. One end of the jib cylinder 9 is connected to the jib 7, and the other end is connected to the pivot member 6. One end of the pivot member cylinder 10 is connected to the base member 5, and the other end is connected to the pivot member 6. In addition, as shown in FIG. 10, guide rollers 21 and 22 for the support and guidance of a lower bridge element are disposed on the base member 5.

Figure 13:
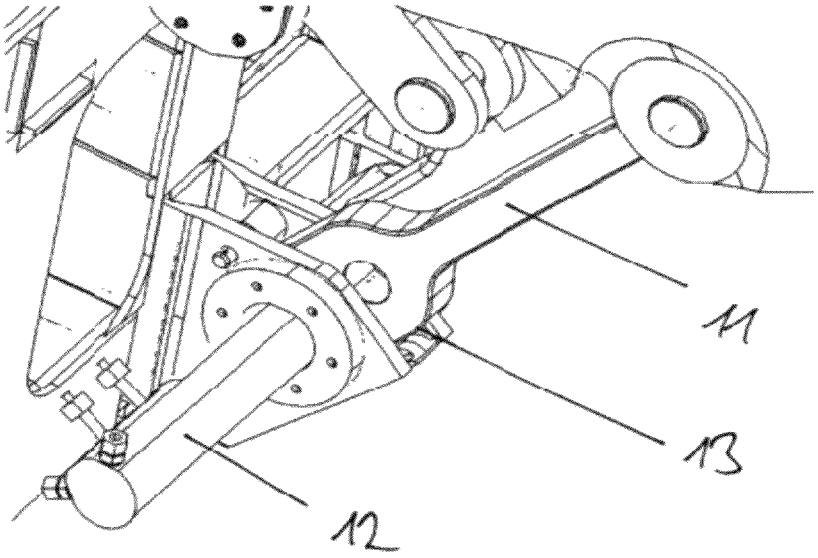
FIG. 13 is a perspective illustration of a portion of the boom of FIG. 7.

In FIGS. 7 and 8, the boom 3 is located in a bridge transporting position, which corresponds to FIG. 3. So that in this position the load of the bridge elements 4.1 does not rest upon the pivot member cylinder 10, disposed between the pivot member 6 and the base member 5 are two struts 11, which can be locked in position by means of two arresting cylinders 12. As illustrated in FIG. 13, the struts 11 run in a guide slot 13 of the base member 5.

Figure 9:
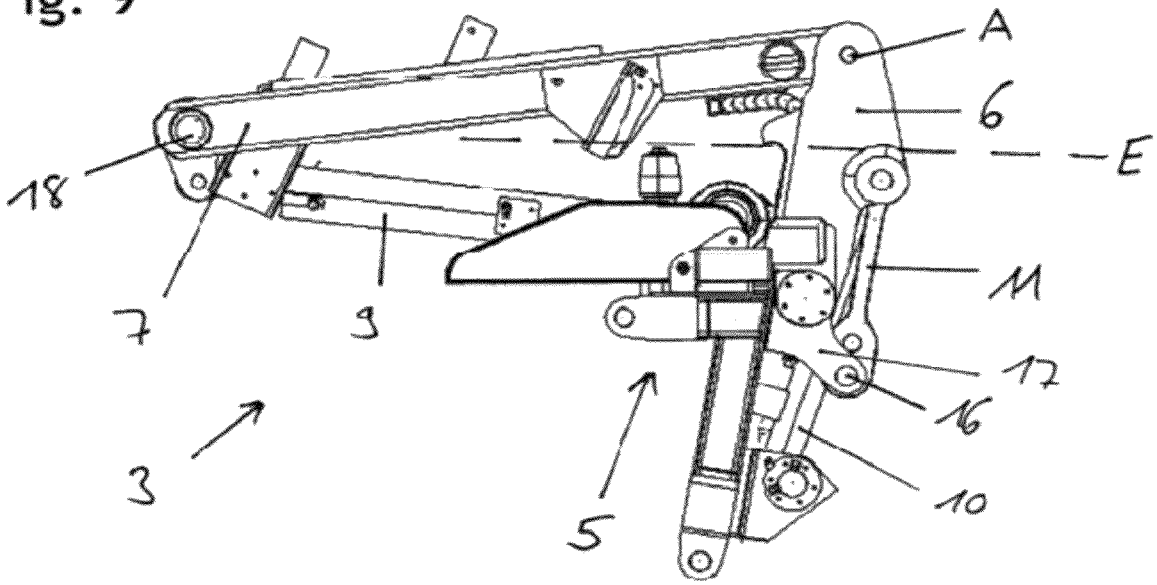
FIG. 9 is a side view of the boom of FIG. 7 in the vehicle transport position.
Figure 10:
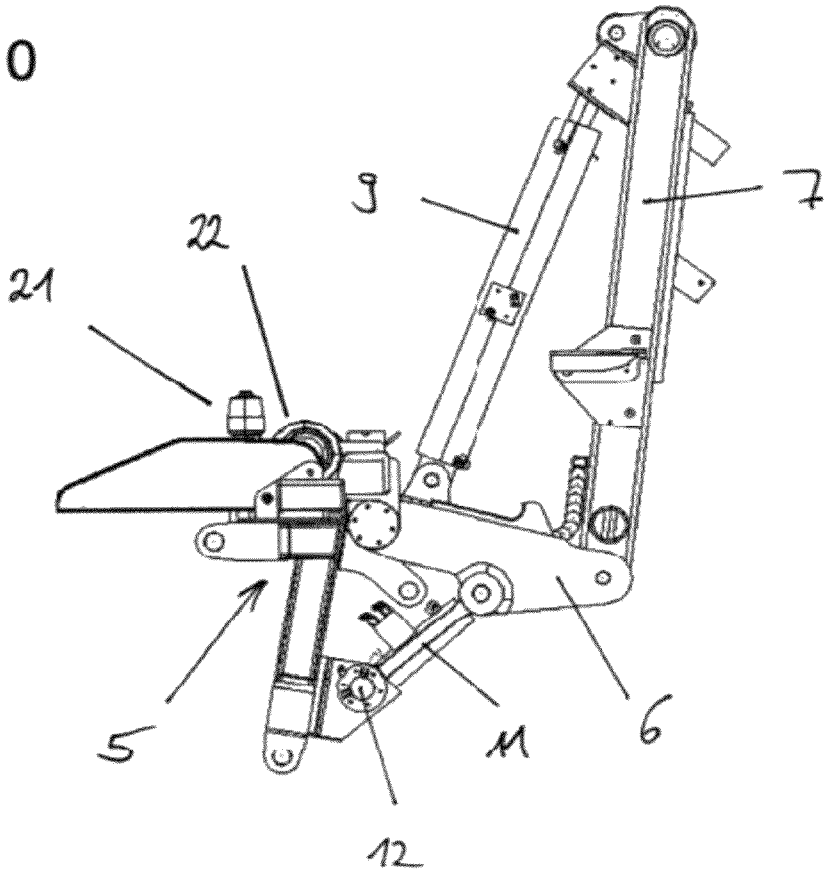
FIG. 10 is a side view of the boom in the position of FIG. 4.
Figure 11:
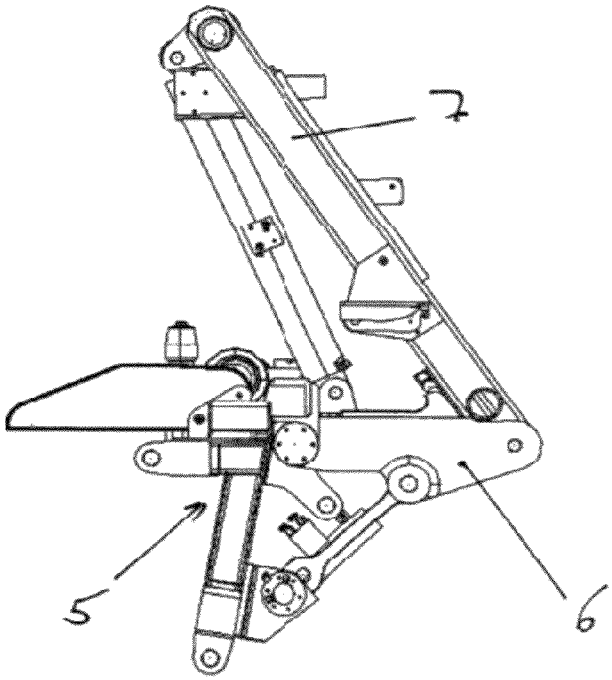
FIG. 11 is side view of the boom in the position of FIG. 5.
Figure 12:
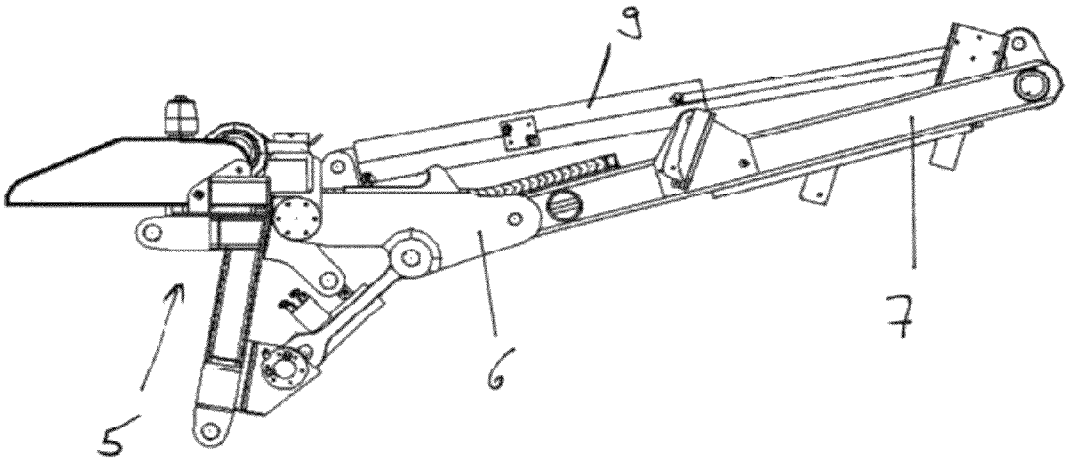
FIG. 12 is a side view of the boom in the position of FIG. 6.

FIGS. 9 to 12 illustrate various positions that the boom 3 can assume. The positions shown in FIGS. 10 and 11 are assumed during transport and during placement of a bridge element respectively. The position illustrated in FIG. 12 is assumed during the coupling of two bridge elements 4.1, as illustrated in FIG. 6. The position illustrated in FIG. 9 corresponds to the vehicle transport position, which is also illustrated in FIG. 1. In order to arrive into this vehicle transport position, first the pivot member 6 is pivoted upwardly by means of the pivot member cylinder 10. in so doing, the pivot axis (A) of the jib 7 moves upwardly. In FIG. 9, the pivot axis (A) is disposed above a horizontal plane (E) that extends through the highest point of an element that is fixedly disposed on the base member 5. Thus, the jib 7 can be pivoted toward the front in an unobstructed manner in the direction of travel (F) of the vehicle. It can assume an essentially horizontal position, whereby tangibly the angle of the jib 7 relative to the horizontal in the position illustrated in FIG. 9 is less than 10°.

As a result of the vehicle position shown in FIG. 9, there results a configuration in which the boom 3 extends a lesser amount above or beyond the base member 5 in the rearward direction (H) and vertical direction (G) than, for example, in the bridge transport position illustrated in FIGS. 10 or 11.

Figure 14:
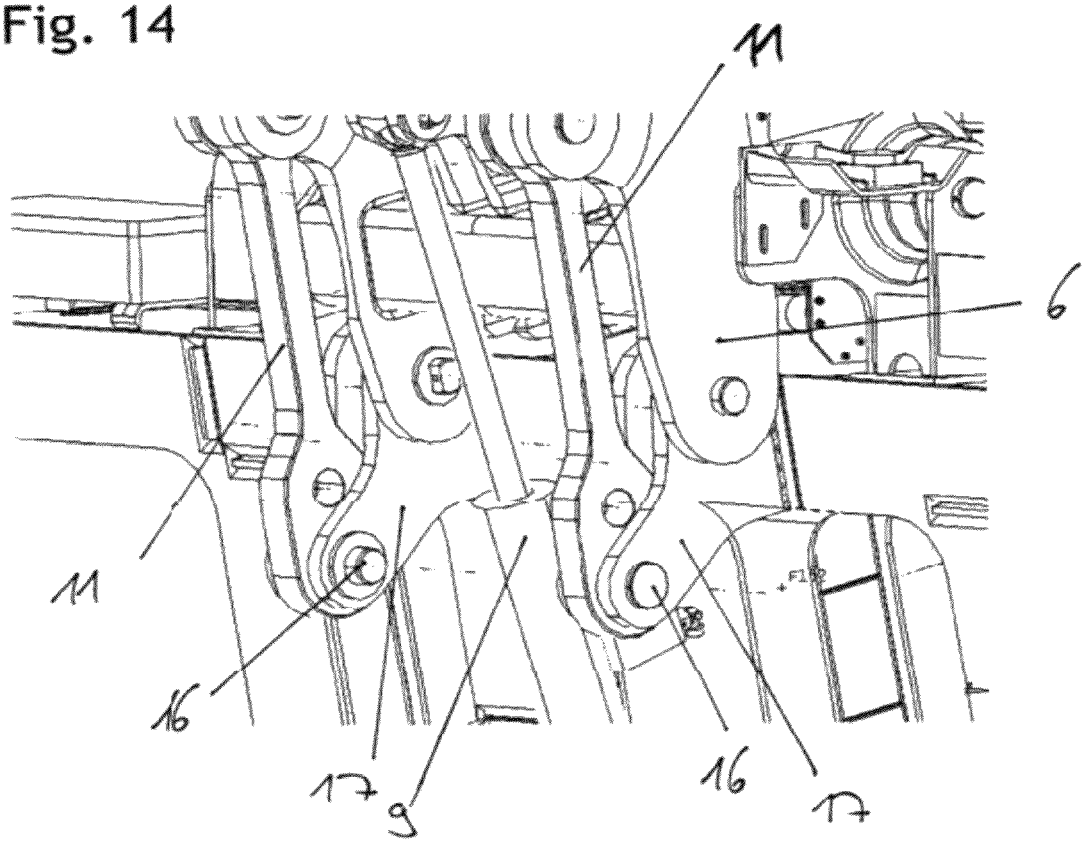
FIG. 14 shows a portion of the boom of FIG. 7 in the vehicle transport position.

In the vehicle transport position, the boom 3 can be fixed in position by two bolts 16, which are illustrated in FIG. 14. For this purpose, the two struts 11 are introduced into a holding device 17, which is provided with bores through which a bolt 16 can be guided. The vehicle transport position is thus initiated without manual contact. Merely the fixation into its position is effected by the connection of the two bolts 16.

Figure 15:
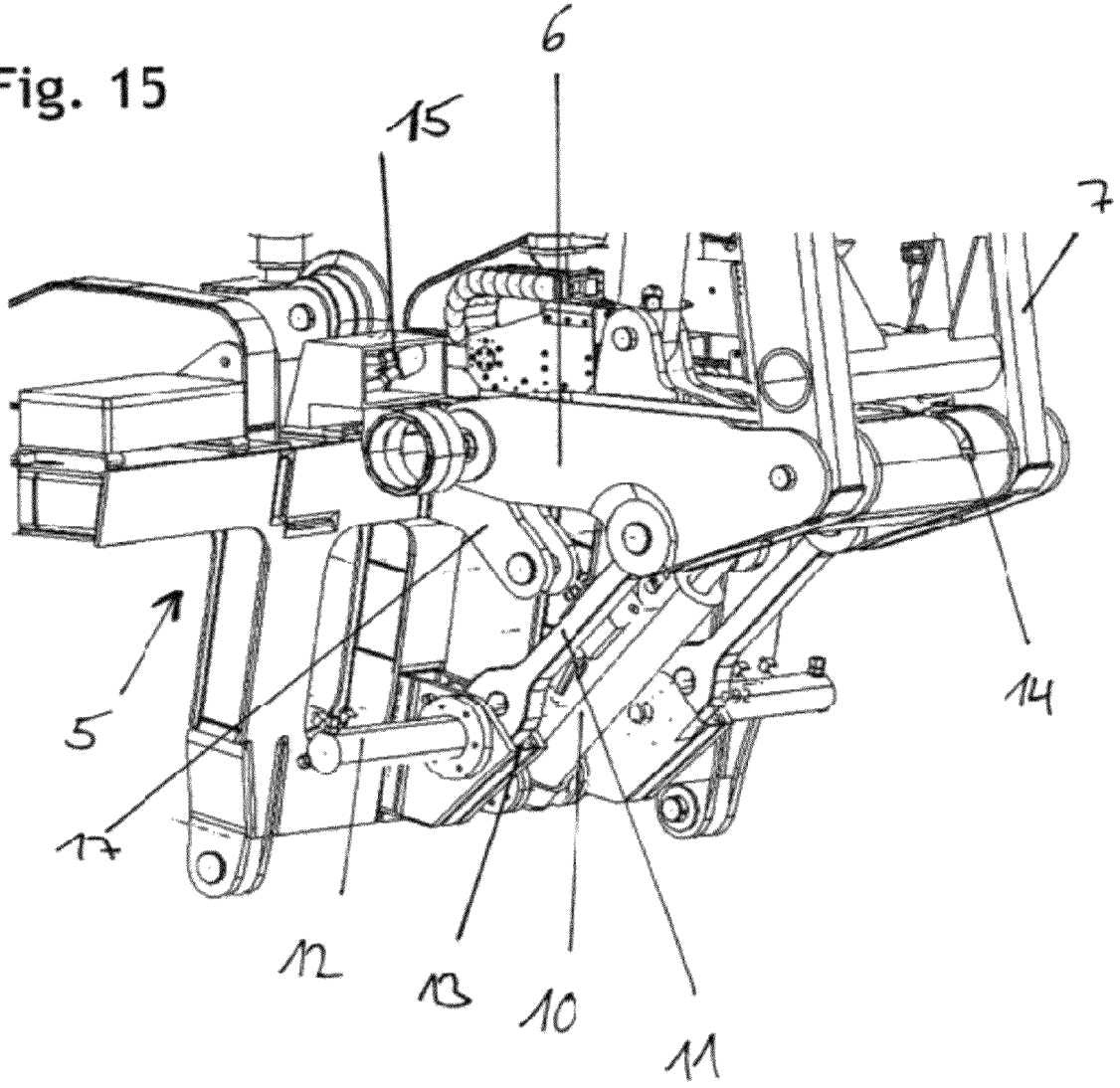
FIG. 15 is a perspective illustration of a portion of the boom of FIG. 7.

The positions of the pivot member 6 and of the jib 7 are monitored by the sensors 14 and 15 illustrated in FIG. 15, so that the various positions can be initiated by a bridge control without there being a safety risk.

Figure 16:
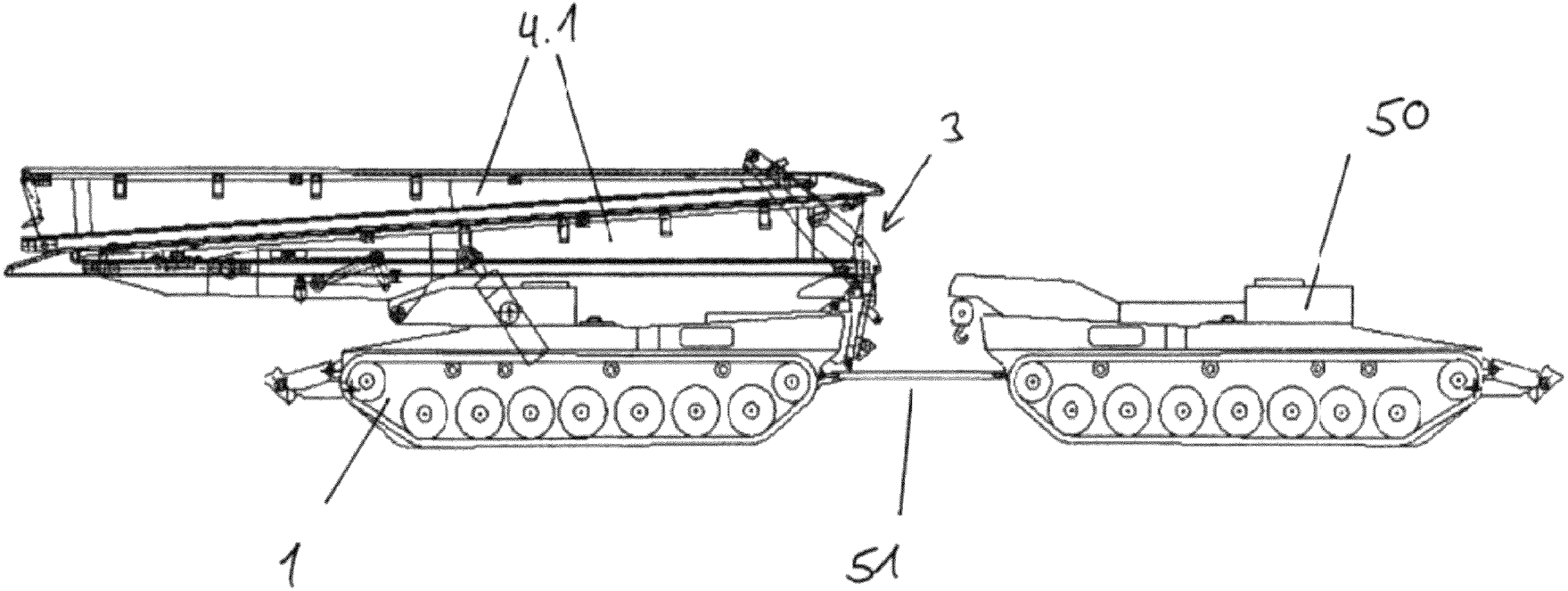
FIG. 16 shows the bridge laying vehicle with the boom in the towing position during towing by a recovery tank.

FIG. 16 shows the bridge laying vehicle 1, which, together with the loaded bridge elements 4.1, is being towed by a recovery tank 50 via a towing rod 51, whereby the boom 3 is located in the towing position, in which the pivot member 6 is pivoted particularly high.

The specification incorporates by reference the disclosure of German priority document 10 2008 007 715.1-25 filed Feb. 6, 2008.

The present invention is, of course, in no way restricted to the specific disclosure of the specification and drawings, but also encompasses any modifications within the scope of the appended claims.

We claim:

1. A bridge laying vehicle (1), comprising:

a laying mechanism for placing bridge elements, wherein the laying mechanism is composed of a placement arm (2) disposed on a first end of the vehicle for placing and taking up the bridge elements and a boom (3) disposed on a second end of the vehicle, wherein the boom comprises: a base member (5); at least one securement device (8) for fixedly securing said base member (5) to said bridge laying vehicle (1); a pivot member (6) pivotably disposed on said base member (5); a jib (7) pivotably disposed on said pivot member (6), wherein for a pivoting movement of said jib (7) relative to said pivot member (6) the boom (3) is provided with a jib adjustment device (9);

at least one strut (11) disposed between said base member (5) and said pivot member (6), wherein in a bridge transport position, said at least one strut (11) carries a part of the load of a bridge element (4.1, 4.2); and a guide slot (13), wherein during a pivoting movement of said pivot member (6) relative to said base member (5) said at least one strut (11) is guided by means of said guide slot (13).

2. The bridge laying vehicle according to claim 1, wherein said jib (7) is provided with at least one locking element (18) for locking a bridge element (4.1, 4.2) in position.

3. The bridge laying vehicle according to claim 1, wherein for a pivoting movement of said pivot member (6) relative to said base member (5) the boom (3) further includes a pivot member adjustment device (10).

4. The bridge laying vehicle according to claim 3, wherein said pivot member adjustment device (10) is a hydraulic cylinder.

5. The bridge laying vehicle according to claim 3, wherein one end of said pivot member adjustment device (10) is supported on said base member (5).

6. The bridge laying vehicle according to claim 3, wherein said jib adjustment device (9) is a hydraulic cylinder and is independent from said pivot member adjustment device (10).

7. The bridge laying vehicle according to claim 1, wherein one end of said jib adjustment device (9) is supported on said pivot member (6).

8. The bridge laying vehicle according to claim 1, which is provided with sensors (14, 15) for sensing the position of at least one of said pivot member (6) and said jib (7).

9. The bridge laying vehicle according to claim 1, which includes a fixation device for fixing the boom (3) in a vehicle transport position.

10. The bridge laying vehicle according to claim 9, wherein said fixation device comprises a plurality of bolts.

11. The bridge laying vehicle according to claim 1, which is embodied in such a way that it is adapted to be brought into a vehicle transport position in which an amount by which the boom (3) extends beyond or above said base member (5) in a rearward direction (H) and/or in a vertical direction (G) is less than in a bridge transport position.

12. A method of moving the boom of the laying mechanism of the bridge laying vehicle of claim 1 into a vehicle transport position, wherein said method includes the step of:

Pivoting said jib (7) about a pivot axis (A) in a forward direction of travel (F) of said bridge laying vehicle (1) by raising said pivot axis (A) of said jib (7).

13. The method according to claim 12, wherein said pivot axis (A) of said jib (7) is raised until said pivot axis (A) lies above a horizontal plane (E) that extends through a highest point of said base member (5).

14. The method according to claim 12, which includes the further steps of providing a pivot member (6) that is pivotably disposed on said base member (5), pivotably disposing said jib (7) on said pivot member (6), and pivoting said pivot member (6) upwardly by means of a pivot member adjustment device (10).

15. The method according to claim 12, wherein in said vehicle transport position said jib (7) forms an angle of +30.degree. to −30.degree. relative to a horizontal.

16. The method according to claim 12, wherein in said vehicle transport position said jib (7) is disposed essentially horizontally.

17. The bridge laying vehicle comprising:

a laving mechanism for placing bridge elements, wherein the laying mechanism is composed of a placement arm (2) disposed on a first end of the vehicle for placing and taking up the bridge elements and a boom (3) disposed on a second end of the vehicle, wherein the boom comprises: a base member (5); at least one securement device (8) for fixedly securing said base member (5) to said bridge laying vehicle (1); a pivot member (6) pivotably disposed on said base member (5); a jib (7) pivotably disposed on said pivot member (6), wherein for a pivoting movement of said jib (7) relative to said pivot member (6) the boom (3) is provided with a jib adjustment device (9);

at least one strut (11) disposed between said base member (5) and said pivot member (6), wherein in a bridge transport position, said at least one strut (11) carries a part of the load of a bridge element (4.1, 4.2); and at least one arresting device (12) for arresting said at least one strut (11) in position.

18. The bridge laying vehicle according to claim 17, wherein said arresting device (12) is an arresting cylinder.

* * * * *